US011414796B2

(12) United States Patent
Meir

(10) Patent No.: US 11,414,796 B2
(45) Date of Patent: Aug. 16, 2022

(54) KNITTED COMPONENT WITH VERTICAL INLAY AND METHOD OF MAKING THE SAME

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 121 days.

(21) Appl. No.: 16/709,209

(22) Filed: Dec. 10, 2019

(65) Prior Publication Data

US 2020/0181814 A1 Jun. 11, 2020

Related U.S. Application Data

(60) Provisional application No. 62/777,563, filed on Dec. 10, 2018.

(51) Int. Cl.

| | |
|---|---|
| ***D04B 1/12*** | (2006.01) |
| ***A43B 1/04*** | (2022.01) |
| ***D04B 15/56*** | (2006.01) |

(52) U.S. Cl.

CPC ..... *D04B 1/123* (2013.01); *A43B 1/04* (2013.01); *D04B 15/56* (2013.01); *D10B 2403/02411* (2013.01); *D10B 2403/032* (2013.01); *D10B 2501/043* (2013.01)

(58) Field of Classification Search

CPC ..... D04B 1/123; D04B 15/56; D04B 15/565; D04B 1/13; D04B 7/14; D04B 15/80; A43B 1/04

See application file for complete search history.

(56) References Cited

U.S. PATENT DOCUMENTS

| | | | | |
|---|---|---|---|---|
| 3,964,277 A * | 6/1976 | Miles | D04B 9/16 66/190 |
| 4,052,865 A * | 10/1977 | Zamarco | D04B 7/26 66/128 |
| 4,183,993 A | 1/1980 | Benstead et al. | |

(Continued)

FOREIGN PATENT DOCUMENTS

| | | |
|---|---|---|
| EP | 0 682 133 A1 | 11/1995 |
| EP | 3 239 376 A1 | 11/2017 |
| JP | 7-305254 A | 11/1995 |

OTHER PUBLICATIONS

International Preliminary Report on Pantentability received for PCT Patent Application No. PCT/US2019/065382, dated Jun. 24, 2021, 9 pages.

(Continued)

*Primary Examiner* — Danny Worrell
(74) *Attorney, Agent, or Firm* — Shook, Hardy & Bacon L.L.P.

(57) ABSTRACT

A knitted component may include a knit element formed with a plurality of courses and a plurality of wales, where the plurality of courses include a first course and the plurality of wales include a first wale and a second wale. A set of inlaid strands including at least a first inlaid strand and a second inlaid strand may be included. A first area and a second area may be included, where in the first area, each inlaid strand of the set of inlaid strands extends through at least a portion of the first course, and where in the second area, the first inlaid strand extends through the first wale and the second inlaid strand extends through the second wale.

18 Claims, 8 Drawing Sheets

(56) References Cited

U.S. PATENT DOCUMENTS

| | | | | | |
|---|---|---|---|---|---|
| 5,299,435 | A * | 4/1994 | Whalley | D04B 1/123 | 66/61 |
| 5,345,789 | A * | 9/1994 | Yabuta | D04B 15/56 | 66/126 A |
| 5,615,562 | A * | 4/1997 | Roell | D04B 15/565 | 66/126 R |
| 6,073,466 | A * | 6/2000 | Marchesi | D04B 1/24 | 66/145 S |
| 6,151,922 | A * | 11/2000 | Shimasaki | D04B 1/18 | 66/61 |
| 8,522,577 | B2 | 9/2013 | Huffa | | |
| 8,839,532 | B2 | 9/2014 | Huffa et al. | | |
| 9,060,570 | B2 * | 6/2015 | Huffa | A43B 23/0225 | |
| 9,226,540 | B2 * | 1/2016 | Podhajny | D04B 15/56 | |
| 9,637,846 | B1 * | 5/2017 | Kuo | D04B 1/123 | |
| 9,644,291 | B1 * | 5/2017 | Kuo | D04B 1/14 | |
| 10,323,344 | B2 * | 6/2019 | Hartmann | D04B 1/14 | |
| 10,753,018 | B2 * | 8/2020 | Kuo | D04B 15/90 | |

OTHER PUBLICATIONS

International Search Report and Written Opinion dated Apr. 22, 2020 for PCT Application No. PCT/US2019/065382, 14 pages.

* cited by examiner

KNITTED COMPONENT WITH VERTICAL INLAY AND METHOD OF MAKING THE SAME

RELATED APPLICATIONS

This application claims priority to U.S. Provisional Application Ser. No. 62/777,563, filed Dec. 10, 2018, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, the wales and courses run roughly parallel.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like-referenced numerals designate corresponding parts throughout the different views.

DETAILED DESCRIPTION

Figure 1:
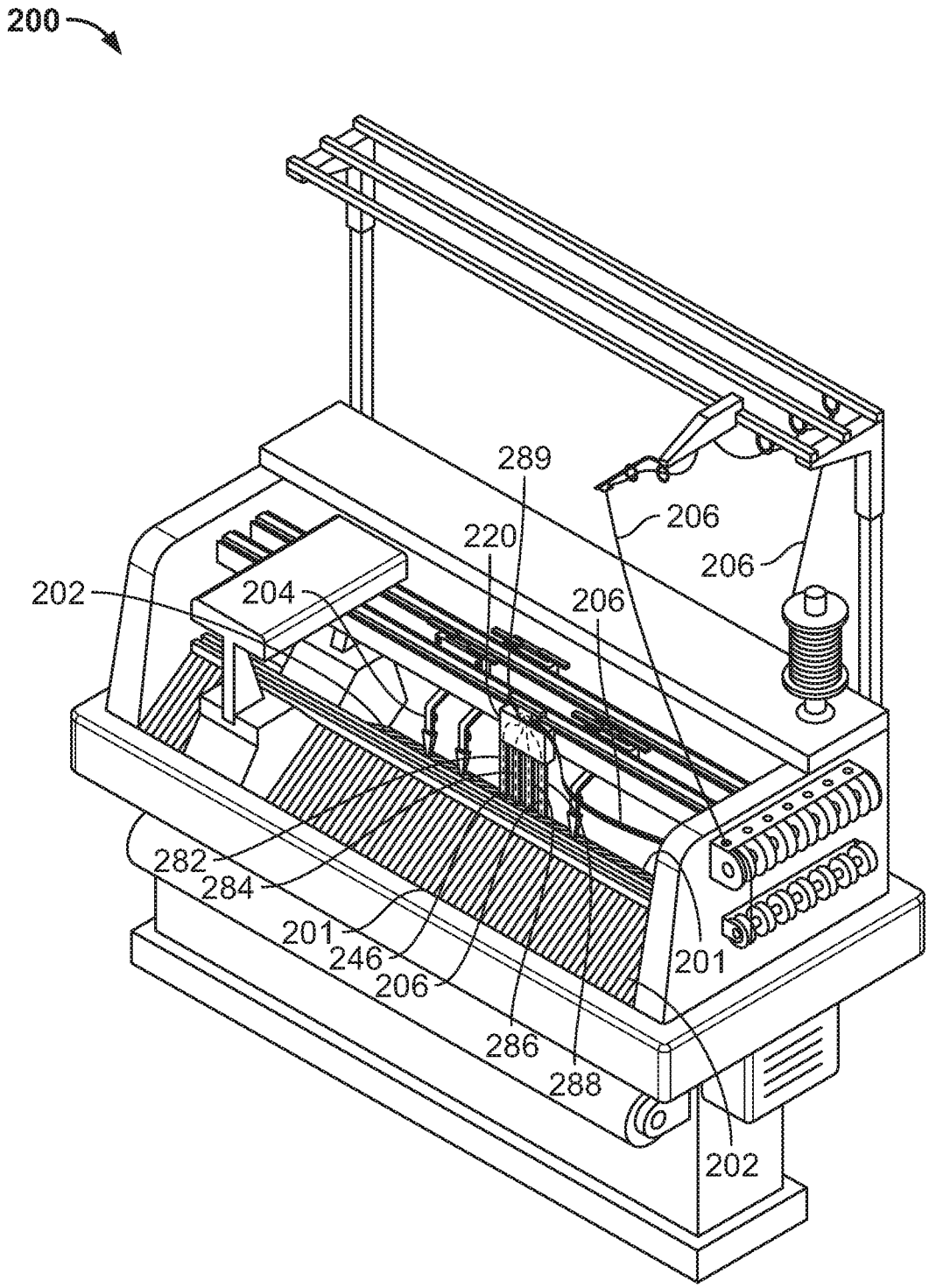
FIG. 1 is an illustration showing a perspective view of a knitting machine in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

One general aspect of the present disclosure includes a knitted component, including: a knit element formed with a plurality of courses and a plurality of wales, where the plurality of courses include a first course and the plurality of wales include a first wale and a second wale; a set of inlaid strands including at least a first inlaid strand and a second inlaid strand; and a first area and a second area, where in the first area, each inlaid strand of the set of inlaid strands extends through at least a portion of the first course, and where in the second area, the first inlaid strand extends through the first wale and the second inlaid strand extends through the second wale.

Another general aspect of the present disclosure includes a method of manufacturing a knitted component, including: moving a first feeder in a first direction to form a first course of the knitted component; moving a second feeder along the first course to a first position such that a set of inlaid strands is inlaid through the first course in the first direction, where the set of inlaid strands includes a first inlaid strand and a second inlaid strand; holding the second feeder in the first position; and moving the first feeder along the first direction while the second feeder is held in the first position such that, as additional courses are formed, the first inlaid strand and the second inlaid strand are respectively inlaid through first and second wales that extend in a second direction, where the second direction is perpendicular to the first direction.

Another general aspect of the present disclosure includes a knitting machine, including: at least one needle bed; a first feeder that is movable along the needle bed for dispensing a first yarn to the at least one needle bed to form a knit element; and a second feeder including a plurality of outlets for dispensing a plurality of strands to form horizontally and vertically inlaid areas within the knit element, where each outlet of the plurality of outlets is configured to dispense at least one strand.

The commercial manufacture of knitted components is generally performed by knitting machines. An example of a knitting machine 200 that is suitable for producing knitted components is depicted in FIG. 1. The knitting machine 200 may include two needle beds 201 that are angled with respect to each other and meet to form an intersection that extends along a majority of a width of the knitting machine 200, thereby forming a V-bed. Each of needle beds 201 may include a plurality of individual needles 202 that lay on a common plane. The knitting machine 200 may also include a first feeder 204 and a multi-strand feeder 220. The first feeder 204 may be movable along the needle bed 201 and may have the ability to supply at least a first yarn (e.g., yarn 211 in FIG. 3) that needles 202 manipulate to knit, tuck, and float. As the first feeder 204 moves along the needle bed 201, a knit element (e.g., knit element 260 in FIG. 3) including at least the first yarn 211 may be formed. The knit element may include a plurality of intermeshed loops defining multiple horizontal courses and vertical wales.

Figure 3:
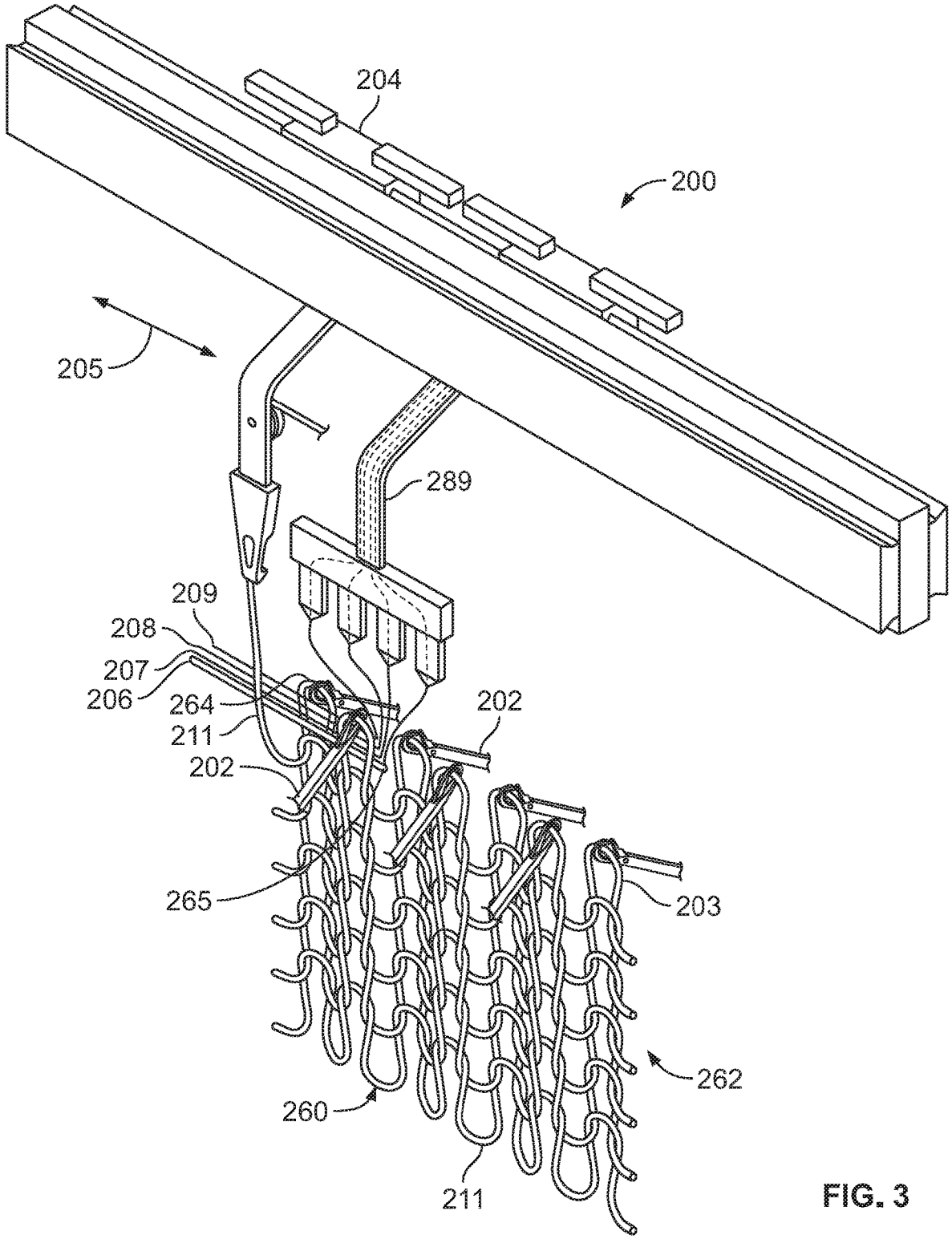
FIG. 3 is an illustration showing a schematic perspective view of a knitting process utilizing the feeder of FIG. 2 to horizontally inlay a set of strands through a first course of a knit element in accordance with certain aspects.

The multi-strand feeder 220 may be movable along the needle bed 201 and may also be held in a plurality of fixed positions while the first feeder 204 is moving along the needle bed 201. The multi-strand feeder 220 may include at least one outlet 282 having a dispensing tip 246 configured to supply a strand (e.g., strand 206) that needles 202 may knit, tuck, and float, as well as to inlay the strand 206 within a course and/or a wale of the knit element. The multi-strand feeder 220 may be movable between a retracted position (a position where the dispensing tip 246 is above the intersection of the needle beds 201) and an extended position (a position where the dispensing tip 246 is below the intersection of the needle beds 201, e.g., as shown in FIG. 3). The multi-strand feeder 220 may supply the strand 206 for knitting, tucking, and floating while in the retracted position. The multi-strand feeder 220 may also horizontally or vertically inlay the strand 206 within the knit element while in the extended position. For purposes of reference, the term "vertically" is intended to describe the direction of the inlaid strand with respect to the direction of the courses that are knit to form the knit element. In other words, "vertically" is intended to describe the "wale wise" direction and "horizontally" is intended to describe the "course wise" direction. That is, the strand is inlaid vertically with respect to a generally horizontal knitting direction of the courses forming the remaining portion of the knitted component. In other words, the vertically inlaid strand is positioned approximately perpendicular to the remaining portion of the knitted component during the knitting process. For example, when knitting on a V-bed flat knitting machine of the type shown in FIG. 1, the inlaid strand will be positioned approximately vertical with respect to the needle beds 201 and the direction of knitting forming the knit element.

It will be appreciated that the "vertically" inlaid strand may not be vertical and the "horizontally" inlaid strand may not be horizontal when the knitted component is removed from the knitting machine and used in something else (e.g., an upper for an article of footwear). Greater details of the knitting machine, the translating movement of the multi-strand feeder, and the method of knitting the knit element with horizontally inlaid strands are depicted and described in U.S. Pat. No. 8,839,532, filed Mar. 15, 2011, which is hereby incorporated by reference in its entirety.

Figure 2:
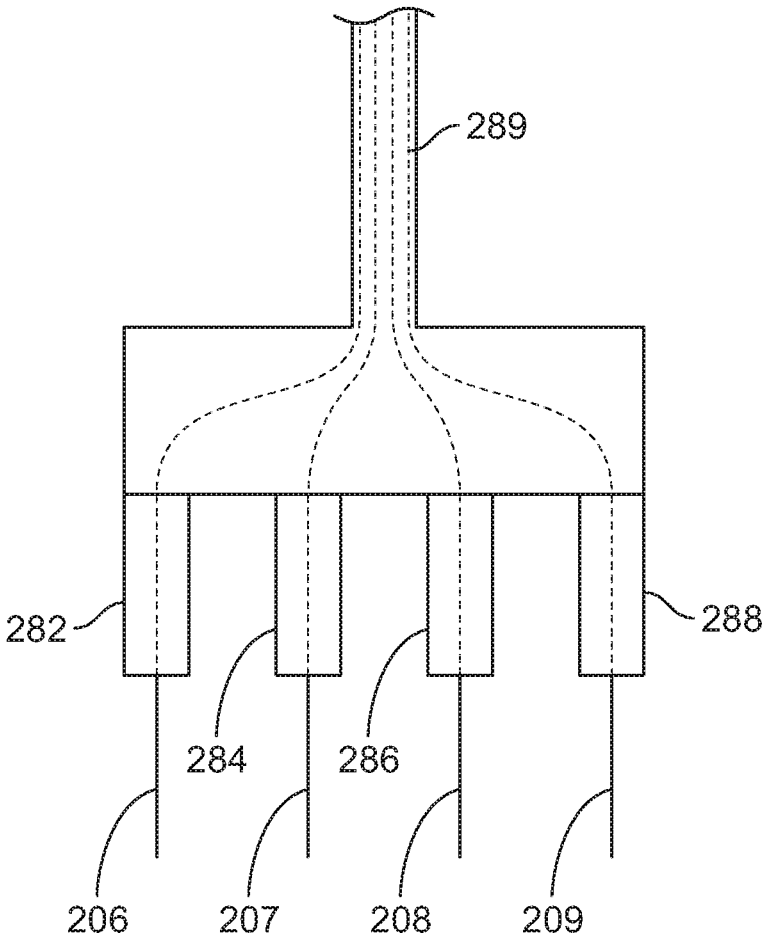
FIG. 2 is an illustration showing a schematic partial, enlarged front view of a portion of a feeder of the knitting machine of FIG. 1 in accordance with certain aspects of the present disclosure.

As shown, the multi-strand feeder 220 may include a common outlet 289 that may receive a plurality of strands to be knitted and/or inlaid within the knit element. The multi-strand feeder 220 may include a plurality of outlets for dispensing the plurality of strands received from the common outlet 289. That is, the common outlet 289 may receive all the strands of the plurality of strands, and then the strands may separate to their respective outlets. Each outlet of the multi-strand feeder 220 may dispense at least one strand of the plurality of strands. In some embodiments, as shown in FIG. 2, the multi-strand feeder 220 may be provided with four outlets 282, 284, 286 and 288. Each of the plurality of outlets may have a tubular configuration. Each outlet may be configured to supply a strand (e.g., strand 206, 207, 208, or 209) such that the plurality of strands supplied by all the outlets of the multi-strand feeder 220 may constitute a set of strands. Each strand of the set of strands may be different or the same. The plurality of outlets may be spaced apart at substantially uniform distances (e.g., as shown in FIG. 2), or at least some of the outlets may be spaced apart at different distances. It will be appreciated that the number, configuration, and spacing of the outlets of the multi-strand feeder 220 may be varied as desired and/or needed without departing from the scope of the present invention. For example, by varying the number of the outlets included by the multi-strand feeder 220, the number of strands that may be simultaneously inlaid within the knit element may be varied. As for another example, the spacing between the outlets may determine the spacing between the respective wales that the set of strands are inlaid within, discussed in greater detail below.

Figure 4:
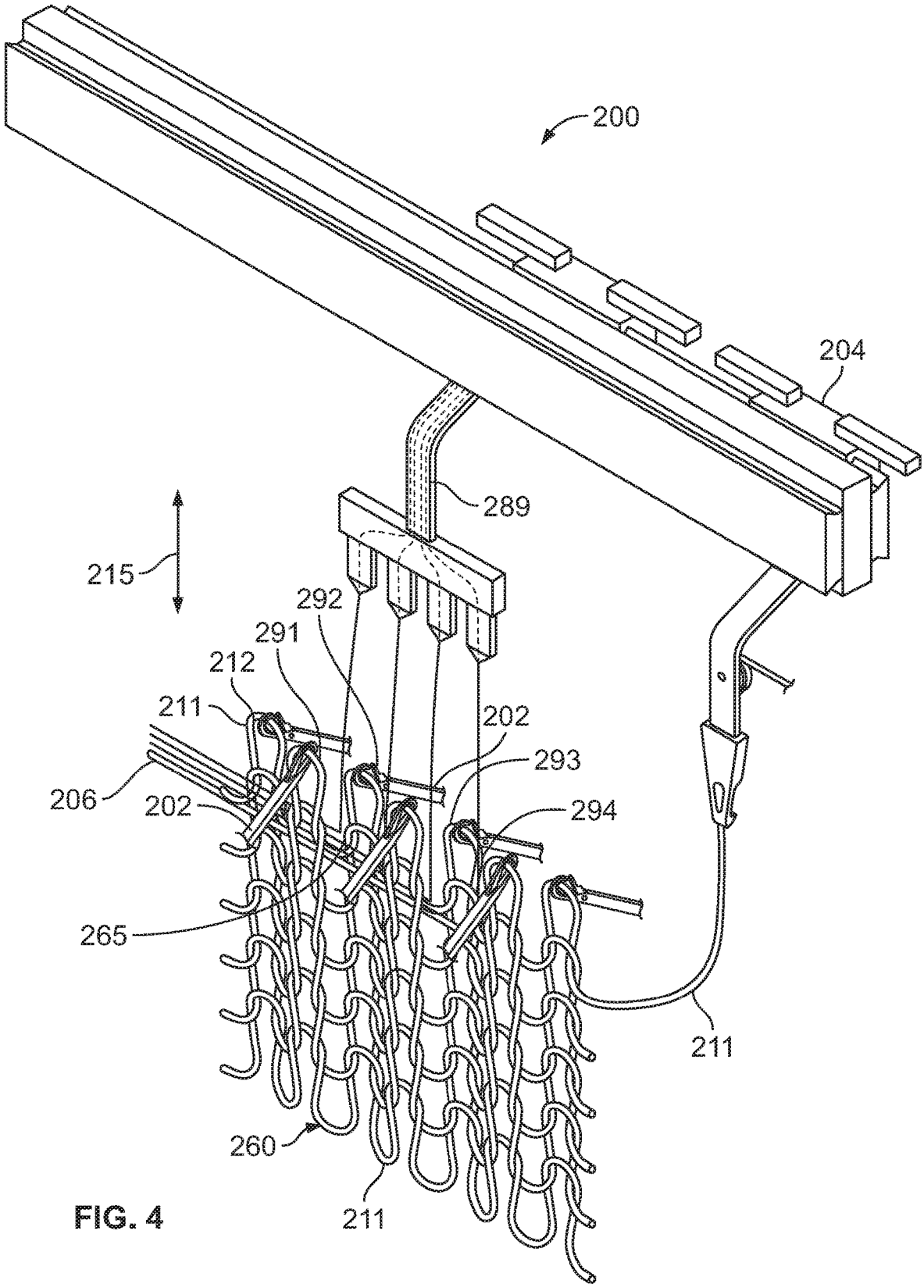
FIG. 4 is an illustration showing a schematic perspective view of a knitting process utilizing the feeder of FIG. 2 to vertically inlay the set of strands through a plurality of wales of the knit element in accordance with certain aspects.

As discussed in greater detail below, the multi-strand feeder 220 may be movable along the needle bed 201 such that the set of strands is horizontally inlaid together within at least a portion of a single course of the knit element (e.g., as shown in FIG. 3). In some embodiments, the multi-strand feeder 220 may also (or alternatively) be configured to be held in a fixed position such that the set of strands extend vertically along respective wales of the knit element in the fixed position (e.g., as shown in FIG. 4). It will be appreciated that the multi-strand feeder 220 is movable such that it can be held in a plurality of fixed positions, and thereby the set of strands may be inlaid within a set of respective wales in a selected fixed position of the plurality of fixed positions.

Referring to FIGS. 3-7, an example of a method of manufacturing a knitted component 262 with horizontally and vertically inlaid areas using the knitting machine 200 discussed above is shown. Initially, as shown in FIG. 3, the first feeder 204 moves along the needle bed 201 and a first course 203 is formed in the knit element 260 from the yarn 211. Continuing with the knitting process, the multi-strand feeder 220 translates from the retracted position to the extended position (such that its dispensing tips, or outlets, are located below the intersection of the needles) and then moves along the first course to a first position 265, such that the strands 206, 207, 208 and 209 are placed between loops of a first portion of the newly formed first course 203. In other words, the plurality of strands 206, 207, 208 and 209 extend through the first portion 264 of the first course 203 along a first direction 205 (e.g., horizontal direction). While the multi-strand feeder 220 stops at the first position 265 in this sample method, it is contemplated that the multi-strand feeder 220 could continue to move through the first course 203 such that the strands 206, 207, 208, and 209 extend through the entire length of the first course 203.

Referring to FIG. 4, after reaching the first position 265, the multi-strand feeder 220 may be held in the first position 265 without further movement along the first course 203 while the first feeder 204 continues knitting. As a result, while the multi-strand feeder 220 is held in the first position 265, portions of the strands 206, 207, 208 and 209 that extend beyond the first position 265 extend approximately vertically by the multi-strand feeder 220 while the knit element 260 grows vertically (due to the knitting of additional courses). This may result in vertical inlaying of the strands 206, 207, 208 and 209 into wales of the knit element 260.

For example, after completion of the first course 203, the first feeder 204 may then move along the needle bed 201 along the first direction 205 to form a second course 212. Loops of the first and second courses are at least partially intermeshed such that a plurality of wales (e.g., first, second, third, fourth wales 291, 292, 293 and 294) are formed and extend substantially perpendicular to the courses. Thus, by forming the second course 212, the portions of the strands 206, 207, 208 and 209 that extend horizontally through the first course 203 and to the first position 265 are horizontally inlaid within a first area 241 (FIGS. 5-7) of the structure of the knit element 260. Moreover, by forming the second course 212 (and then subsequent courses) while holding the multi-strand feeder 220 in place, the portions of the strands 206, 207, 208 and 209 that extend beyond the first position 265 (e.g., vertically towards the multi-strand feeder 220 in FIG. 4) respectively extend through the wales 291, 292, 293 and 294 along a second direction 215 (e.g., vertical direction). That is, the strands 206, 207, 208 and 209 are each vertically inlaid within a respective wale 291, 292, 293 or 294 in the second area 242 (FIGS. 5-7) of the structure of the knit element 260. It will be appreciated that the second strand 207 may extend through a portion of the first course 203 located between the first wale 291 and the second wale 292, the third strand 208 may extend through a portion of the first course 203 located between the second wale 292 and the third wale 293, and the fourth strand may extend through a portion of the first course 203 located between the third wale 293 and the fourth wale 294. The wales 291, 292, 293 and 294 may be adjacent to or spaced apart from each other, depending on the spacing between the plurality of outlets of the multi-strand feeder 220. For example, in some embodiments, at least one wale is located between the first and second wales 291 and 292. Further, it is contemplated that more than one strand may extend through a single wale.

Figure 5:
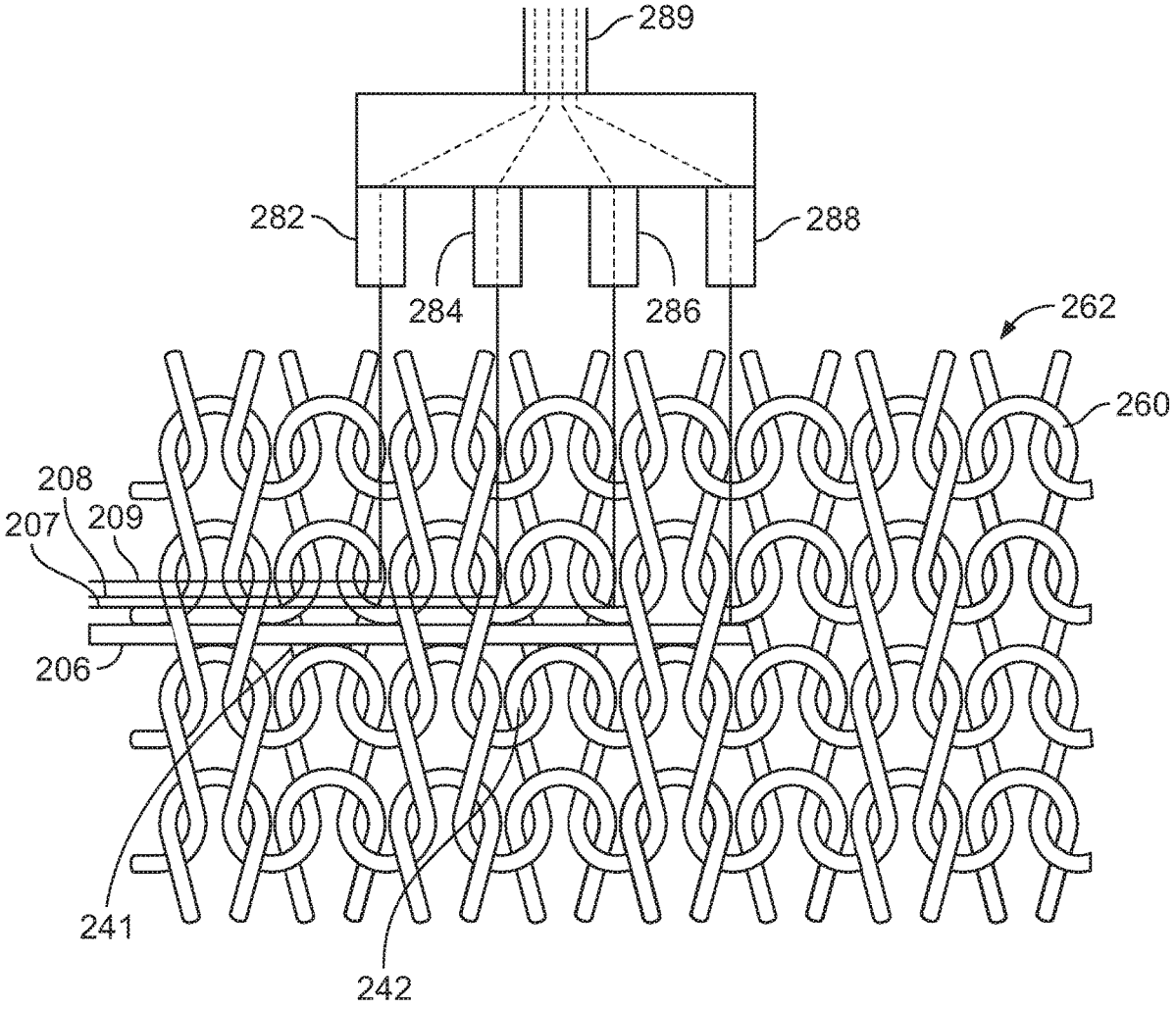
FIG. 5 is an illustration showing a plan view of knit structures of a knitted component with horizontally and vertically inlaid strands in accordance with certain aspects.
Figure 6:
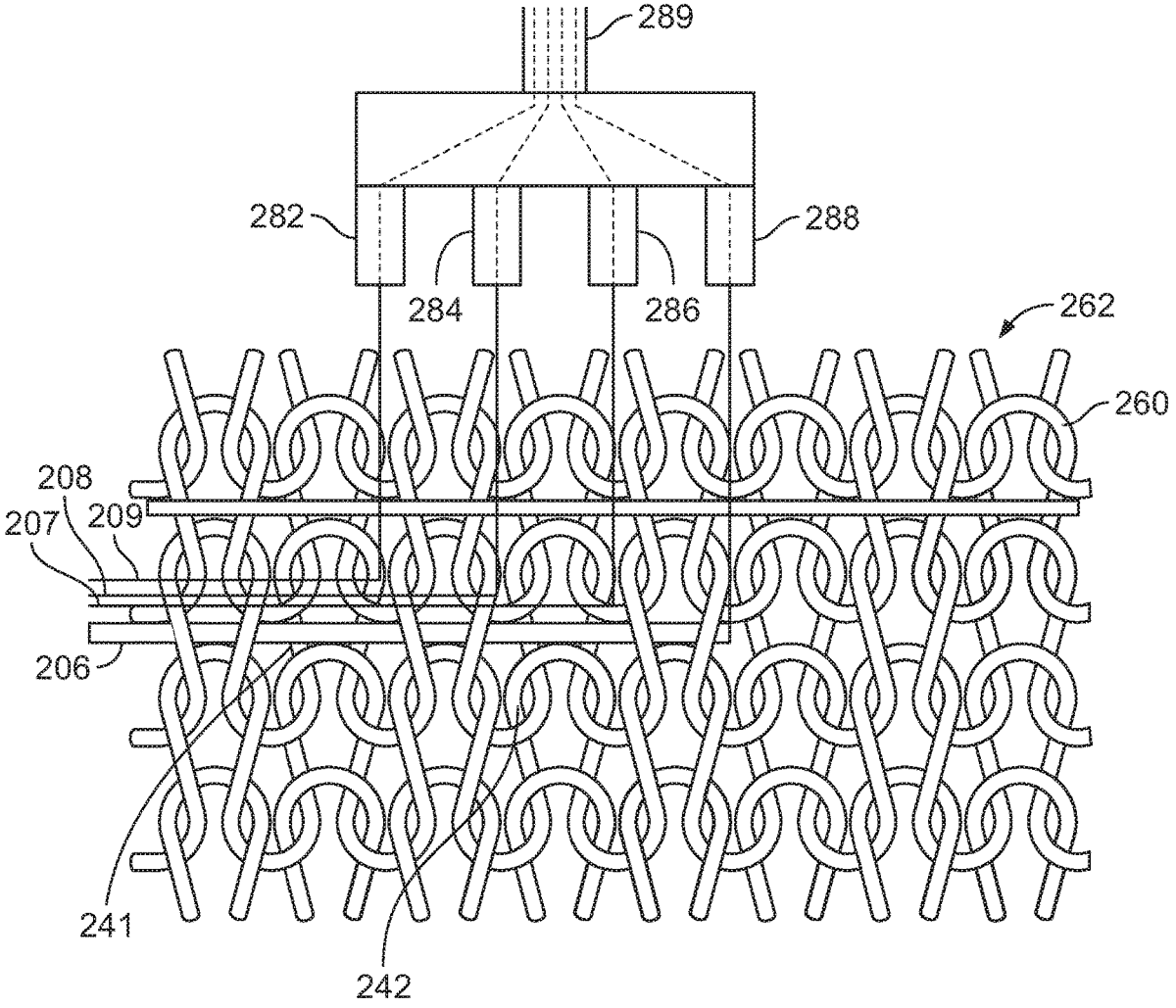
FIG. 6 is an illustration showing a plan view of knit structures of a knitted component with cross-hatched horizontal and vertical inlays in accordance with certain aspects.

Continuing to hold the multi-strand feeder 220 in the fixed first position 265, as the first feeder 204 knits additional courses from the yarn 211 that form the knit element 260, the knitted component 262 moves downward (and the plurality of wales (e.g., the first through fourth wales 291, 292, 293 and 294) increase in length) such that the set of strands (e.g., the first through fourth strands 206, 207, 208 and 209) are vertically inlaid respectively within their respective wales (e.g., shown in FIG. 5). As more of the knit element 260 is formed, the length of the vertically inlaid portions of the strands 206, 207, 208, and 209 increases. This process (holding the multi-strand feeder 220 (and thus the set of strands 206, 207, 208 and 209) in a fixed first position 265 as additional courses are formed) may be repeated as many times as is desired and/or needed until the vertically inlaid portions of the strands 206, 207, 208, and 209 have a desirable length. In some embodiments, as shown in FIG. 6, when the first feeder 204 is moving along the needle bed 201 to form additional courses as the multi-strand feeder 220 is held in the fixed position to form vertical inlays in the knitted component, another inlay feeder may move horizontally along the additional courses to form additional horizontal inlays (e.g., using the same method as discussed above), such that cross-hatched horizontal and vertical inlays may be formed in the knitted component.

An advantage of the method discussed above is that a single knitted component (e.g., formed on a knitting machine without significant post-processing steps) may have inlaid strands extending in multiple directions. For example, a single knitted component may have areas with vertically inlaid strands and horizontally inlaid strands as discussed above, which may provide stretch-resistance in selected areas and/or particular directions. Further, the multi-strand feeder 220 (with multiple outlets) provides the ability, using the same set of strands, to form areas where a single course holds more strands than a single wale, which was not possible with previously-known knitting technology. For example, when a multi-strand feeder 220 with four outlets is used (as described above) and assuming only one strand is dispensed through each outlet, at least a portion of a course may include multiple inlaid strands (e.g., four strands are horizontally inlaid within a course in the first area 241). That same multi-strand feeder 220, with the same four strands, when inlaying vertically through respective wales, may provide each wale with only one inlaid strand (e.g., one strand is vertically inlaid within a wale in the second area 242). This may be accomplished within an integrally and continuously-formed one-piece knitted component 262 during the same process as the formation of the remainder of the one-piece knitted component 262, without the need for changing feeders and/or inlaid strands to change the orientation of the inlay or to supply different numbers of inlaid strands for different areas during the knitting process. Further, when a knitted component is desired with inlaid strands extending in multiple directions, such a knitted component can be formed in accordance with the present teachings without cutting and then sewing different knitted components together, thus enhancing manufacturing efficiency, increasing durability of the completed knitted component, reducing waste and scrap, etc.

Figure 7:
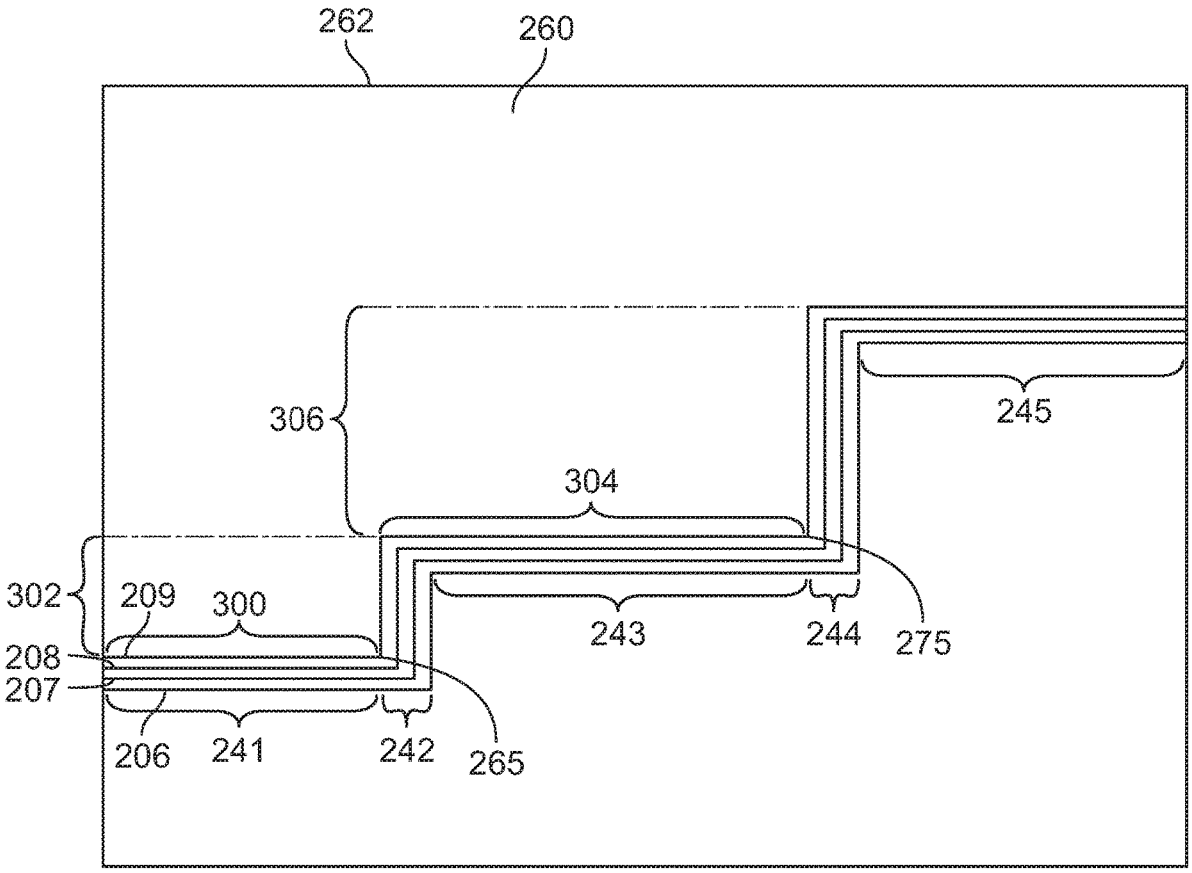
FIG. 7 is an illustration showing a schematic plan view of a knitted component with horizontally and vertically inlaid areas in accordance with certain aspects.

Once the vertically inlaid area (e.g., the second area 242) reaches the desired dimension, the methods discussed above of horizontally inlaying a set of strands within a portion of a course of the knit element 260 and vertically inlaying each of the set of strands within a portion of a wale of the knit element 260 may be repeated to form a knitted component 262 with a plurality of horizontally inlaid areas and a plurality of vertically inlaid areas. For example, as shown in FIG. 7, after forming the horizontally inlaid area (e.g., the first area 241) and the vertically inlaid area (e.g., the second area 242), other horizontally inlaid areas may be formed (e.g., the third area 243 and the fifth area 245) by moving the multi-strand feeder 220 along a portion of the respective courses, and another vertically inlaid area (e.g., the fourth area 244) may be formed by holding the multi-strand feeder 220 in a respective fixed position as the first feeder 204 moves along the needle bed 201 to form additional courses (similar to as discussed above). In some embodiments, the horizontally inlaid area (e.g., the first area 241) may have a greater thickness than the vertically inlaid area (e.g., the second area 242) because in the horizontally inlaid area, the set of strands are bunched together to extend through at least a portion of a single course while in the vertically inlaid area, the set of strands are separated and only one strand of the set of strands may extend through a single wale.

The dimensions of the vertically inlaid areas and the horizontally inlaid areas may be varied as desired and/or needed by slightly changing the knitting process. For example, the lengths of the vertically inlaid areas (e.g., areas 242, 244) may be varied by changing the lengths (e.g., 302, 306) of a portion of the respective wales, which is to change the number of newly formed courses when the multi-strand feeder 220 is held in the respective fixed positions (e.g., 265, 275). As for another example, the widths of the horizontally inlaid areas (e.g., areas 241, 243) may be varied as desired and/or needed by changing the lengths (e.g., 300, 304) of a portion of the respective courses, which is to change the lengths of the portions of the respective courses the multi-strand feeder 220 continues to operate along.

Moreover, the multi-strand feeder 220 may be configured to dispense a variety of different strands (e.g., filament, thread, rope, webbing, cable, chain, or yarn), and by including various yarn types in the set of strands inlaid within the knit element 260, the knitted component 262 may impart various properties to different areas. In some embodiments, cushioning yarns may be provided within the set of strands, such that the amount or degree of cushioning in the first area 241 may be greater than the second area 242. In some embodiments, the inlaid strands may have a high stretch resistance such that stretchability in the vertical direction may be reduced in the vertically inlaid areas and stretchability in the horizontal direction may be reduced in the horizontally inlaid areas. In some embodiments, varying yarn types may be included within the set of strands to provide desired and/or needed properties to specific areas of the knitted component. It will also be appreciated that by varying the number of strands supplied by the multi-strand feeder 220, the properties of the horizontally and vertically inlaid areas may also be similarly varied. For example, by including a greater number of yarns (e.g., cushioning yarns) in the set of strands, the amount or degree of cushioning may be similarly increased in both of the horizontally and vertically inlaid areas.

Figure 8:
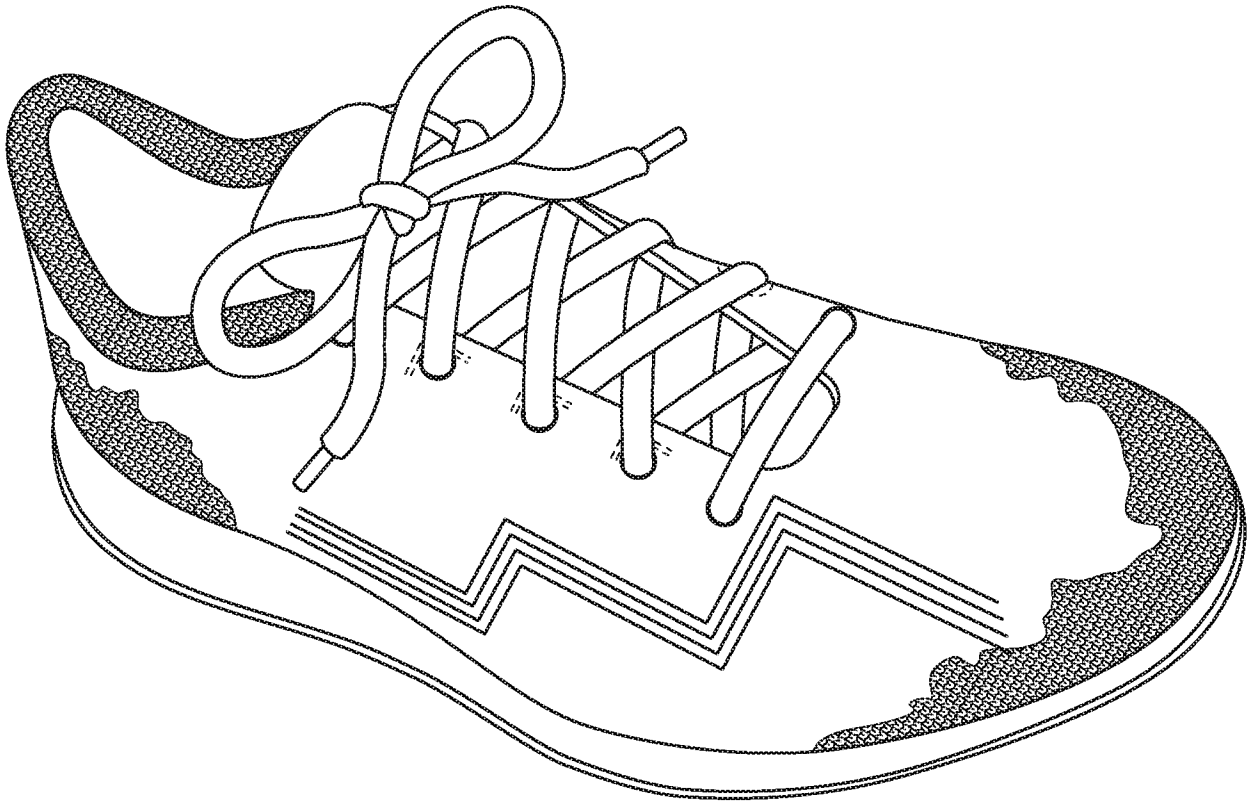
FIG. 8 is an illustration showing a schematic perspective view of an article of footwear including an upper formed from the knitted component of FIG. 7.

When the knitted component 262 is incorporated into an upper of an article of footwear (e.g., as shown in FIG. 8), different types of inlaid strands may be selected to impart varying stretch-resistance, wear-resistance, flexibility, air-permeability, compressibility, comfort, color, and moisture-wicking to different areas of the knitted component 262, thereby imparting proper properties and advantages to different areas of the upper. For example, the upper may include inlaid cushioning areas with different levels of cushioning/stiffness at selected locations with respect to the skeletal structure and other anatomy of a wearer's foot to provide cushioning protection and/or stability for the wearer's foot. For example, cushioning areas with a lesser relative stiffness in compression may be positioned at locations most likely to experience impact loads during running and like activities. Cushioning areas with a greater relative stiffness in compression may be positioned at locations where impact loads are unlikely and greater resistance is needed to stabilize the running motion. Different areas of the upper may require different degrees of cushioning. By using the methods discussed above, a knitted component 262 may be provided with multiple horizontally inlaid areas to provide a higher degree of cushioning and also multiple vertically inlaid areas to provide a less degree of cushioning, and their respective locations may be predetermined according to the specific needs of the wearer. In addition, different areas of the upper may require different degrees or orientations of strechability. For example, certain portions of an article of footwear (e.g., the heel area) may experience concentrated force during typical use, thus requiring a single set of strands in a particular location to provide a high degree of strength and/or stretch resistance. Other areas (e.g., the medial and/or lateral side of the article of footwear) may be enhanced if forces are more distributed over a larger area, and therefore multiple separated inlaid strands may be more effective. By using the methods discussed above, a knitted component 262 may be provided with one or more horizontally inlaid areas to deal with concentrated forces and also multiple vertically inlaid areas to provide a less degree of stretch-resistance in the vertical direction while distributing forces over a particular area. These respective locations may be predetermined according to the design of the article of footwear based on the specific needs of one or more wearers.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

I claim:

1. A knitted component, comprising:

a knit element formed with a plurality of courses and a plurality of wales, the plurality of courses comprising a first course and the plurality of wales comprising a first wale and a second wale;

a set of inlaid strands comprising at least a first inlaid strand and a second inlaid strand; and a first area and a second area, wherein in the first area, each inlaid strand of the set of inlaid strands extends through at least a portion of the first course, and wherein in the second area, the first inlaid strand extends through the first wale and the second inlaid strand extends through the second wale, and wherein in the second area, the second inlaid strand extends through a portion of the first course located between the first wale and the second wale.

2. The knitted component of claim 1, wherein in the second area, the first inlaid strand and the second inlaid strand extend vertically through at least a portion of the first wale and the second wale respectively.

3. The knitted component of claim 1, wherein the set of inlaid strands further comprises a third inlaid strand and a fourth inlaid strand, wherein the plurality of wales further comprises a third wale and a fourth wale, and wherein in the second area, the third inlaid strand and the fourth inlaid strand respectively extend through at least a portion of the third wale and the fourth wale.

4. The knitted component of claim 3, wherein in the first area, the third inlaid strand and the fourth inlaid strand both extend through at least a portion of the first course.

5. The knitted component of claim 1, wherein the first wale is adjacent to the second wale.

6. The knitted component of claim 1, wherein at least one wale is located between the first wale and the second wale.

7. The knitted component of claim 1, wherein the first area is adjacent to the second area.

8. The knitted component of claim 1, wherein the first area has a first thickness and the second area has a second thickness less than the first thickness.

9. The knitted component of claim 1, wherein the first area has a first amount of cushioning and the second area has a second amount of cushioning less than the first amount.

10. The knitted component of claim 1, wherein the set of inlaid strands extends along the first course to a first position where the first course intersects the first wale, and wherein in the first position, the first inlaid strand changes in direction from extending horizontally through the first course to extending vertically through the first wale.

11. The knitted component of claim 1, wherein the set of inlaid strands comprises a cushioning yarn.

12. The knitted component of claim 1, wherein the set of inlaid strands comprises a yarn having a stretch-resistance that is higher than yarns forming the knit element.

13. The knitted component of claim 1, wherein the set of inlaid strands comprises a third inlaid strand, and wherein in the second area, the second and third inlaid strands both extend through the second wale.

14. A method of manufacturing a knitted component, comprising:

moving a first feeder in a first direction to form a first course of the knitted component;

moving a second feeder along the first course to a first position such that a set of inlaid strands is inlaid through the first course in the first direction, the set of inlaid strands comprising a first inlaid strand and a second inlaid strand;

holding the second feeder in the first position; and moving the first feeder along the first direction while the second feeder is held in the first position such that, as additional courses are formed, the first inlaid strand and the second inlaid strand are respectively inlaid through first and second wales that extend in a second direction, the second direction being perpendicular to the first direction.

15. The method of manufacturing the knitted component of claim 14, further comprising:

moving the second feeder along a third course that is formed later on to a second position such that the set of inlaid strands extends through a second portion of the third course along the first direction, wherein the second feeder comprises a first outlet for dispensing the first inlaid strand and a second outlet for dispensing the second inlaid strand.

16. The method of manufacturing the knitted component of claim 14, wherein the first direction is approximately a horizontal direction during a knitting process, and wherein the second direction is approximately a vertical direction during the knitting process.

17. The method of manufacturing the knitted component of claim 14, wherein the second feeder is movable such that it can be held in a plurality of fixed positions, each fixed position being associated with inlaying the set of inlaid strands within a selected set of respective wales.

18. The method of manufacturing the knitted component of claim 14, wherein the second feeder comprises a plurality of outlets for dispensing a plurality of inlaid strands, and wherein each outlet of the plurality of outlets is configured to dispense at least one inlaid strand, and wherein the second feeder comprises a common inlet for receiving each inlaid strand of the plurality of inlaid strands.

* * * * *